United States Patent [19]

Mantlik

[11] Patent Number: 4,583,805

[45] Date of Patent: Apr. 22, 1986

[54] LOCKING ARRANGEMENT FOR ELECTRICAL CONTACT ELEMENT INSERTABLE INTO HOUSING CHAMBER

[75] Inventor: Konrad Mantlik, Wuppertal, Fed. Rep. of Germany

[73] Assignee: Grote & Hartmann GmbH & Co. KG, Wuppertal, Fed. Rep. of Germany

[21] Appl. No.: 547,052

[22] Filed: Oct. 28, 1983

[30] Foreign Application Priority Data

Dec. 18, 1982 [DE] Fed. Rep. of Germany ..... 3247022

[51] Int. Cl.[4] ..... H01R 11/22

[52] U.S. Cl. ..... 339/61 R; 339/59 R; 339/217 S

[58] Field of Search ..... 339/59 R, 59 M, 61 R, 339/61 M, 176 MP, 217 S, 91 R, 91 F

[56] References Cited

U.S. PATENT DOCUMENTS 3,824,523 7/1974 McGhee ..... 339/59 R 4,433,888 2/1984 Winger ..... 339/217 S

*Primary Examiner*—Gil Weidenfeld

*Assistant Examiner*—Paula A. Austin

*Attorney, Agent, or Firm*—Michael J. Striker

[57] ABSTRACT

A locking arrangement for an electrical connector insertable into a housing chamber has a locking mount which is provided with arresting elements and locking elements, wherein arresting elements cooperate with further arresting elements arranged outwardly of the walls of the housing chamber.

9 Claims, 4 Drawing Figures

LOCKING ARRANGEMENT FOR ELECTRICAL CONTACT ELEMENT INSERTABLE INTO HOUSING CHAMBER

BACKGROUND OF THE INVENTION

The present invention relates to a locking arrangement for an electrical contact element insertable into a housing chamber. More particularly, it relates to a locking arrangement for an electrical contact element, for example a double flat spring contact insertable in a chamber of a synthetic plastic housing.

Electrical contact elements formed for example of a sheet steel or so-called electrical connectors insertable into a housing chamber, have as a rule an arresting tongue which engages behind an edge of the housing so as to prevent pulling or slipping the connection out of the housing. In addition, it is known to form locking arrangements as auxiliary locking members which are arranged on the housing and during turning of the housing to its closing position can engage and displace an electrical connector which has been previously inserted into the housing chamber and finally close the insertion opening of the housing chamber so as to divide the electrical connector into partitions.

The known auxiliary locking elements arranged on the housing side are especially suitable for a housing which has a plurality of housing chambers arranged parallel and adjacent to one another. The connector must be inserted with a predetermined position, since otherwise the auxiliary locking members do not function. Moreover, the copper housing requires considerable expenses during its manufacture.

SUMMARY OF THE INVENTION

Accordingly, it is an object of the present invention to provide a locking arrangement for an electrical connector insertable into a housing chamber, which avoids the disadvantages of the prior art.

More particularly, it is an object of the present invention to provide a locking arrangement for an electrical connector insertable into a housing chamber which is easy to manufacture, can also be used for an individual housing chamber, fixes and locks the connector in the housing chamber regardless of the position of the connector, and therefore maintains manufacturing costs at a very low level.

In keeping with these objects and with others which will become apparent hereinafter, one feature of the present invention resides, briefly stated, in a locking arrangement for an electrical connector insertable into a housing wall, which has a locking mount provided with arresting elements and locking elements wherein the arresting elements cooperate with further arresting elements arranged outwardly on the walls of the housing chamber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
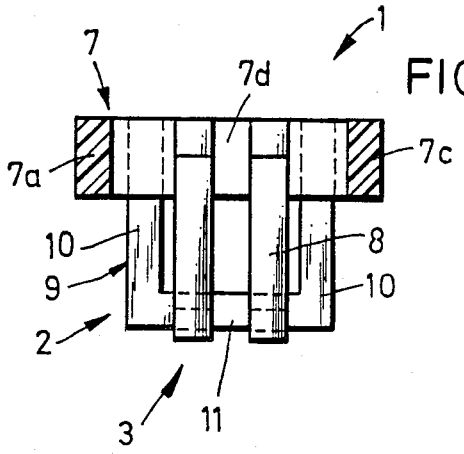
FIG. 1 is a view showing a longitudinal section of a locking mount of a locking arrangement in accordance with the present invention.

A locking arrangement in accordance with the present invention has a locking mount which is identified with reference numeral 1 and is provided with arresting elements 2 and locking elements 3. The arresting elements 2 cooperate with arresting elements 4 arranged on outer walls 5 of a housing.

The locking mount 1 of a synthetic plastic material has contours corresponding to the contours of a housing chamber 6 to be locked. In the shown example the locking mount 1 in a plan view (FIG. 2) has a rectangular closed frame 7 with frame walls *7a, 7b, 7c* and *7d* having also a rectangular cross-section.

The locking elements are formed by two pin-shaped stoppers 8 provided on the inner surface of the frame wall *7d* and spaced laterally from one another by a certain distance symmetrically relative to the center of this wall. The stoppers 8 advantageously have a rectangular cross-section and extend parallel to one another and normally in a downward direction (FIG. 1) so as to project beyond the frame wall *7d* over substantially at double length. Two further stoppers 8 are provided on the frame wall *7b* opposite to the first mentioned stoppers 8 and arranged identically to the latter. In accordance with the present invention it is possible that the frame walls *7a* and *7c* are provided with such stoppers, or all four walls are provided with such stoppers.

The arresting element 2 formed as an arresting bracket 9 is located on the outer surface of the frame wall *7d*. The arresting bracket 9 includes two bracket arms 10 extending at a distance parallel to one another and normally downwardly and having advantageously a rectangular cross-section. The bracket arms 10 are connected with one another at their ends by a transverse piece 11. The arresting bracket 9 projects beyond the frame wall *7d* over a length substantially equal to the length of the projection of the stopper 8. An identical arresting bracket 9 is provided on the outer surface of the frame wall *7b*. In accordance with the present invention, it is also possible to provide such arresting brackets on the outer surfaces of the frame walls *7a* and *7c*, or only on the frame walls *7a* and *7c* instead of the frame walls *7b* and *7d*.

Figure 4:
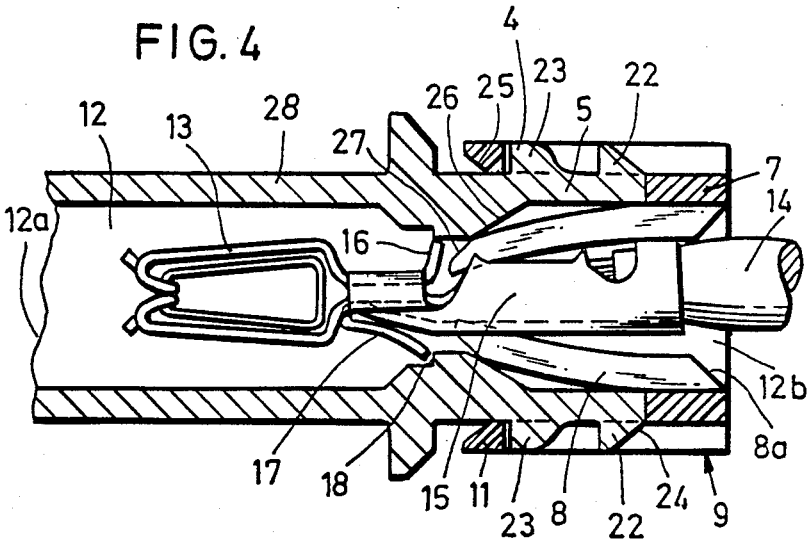
FIG. 4 is a view showing a longitudinal section of the inventive locking arrangement with its locking mount in an end arresting position.

The inventive locking mount is inserted in a housing which has a chamber 12 for insertion of an electrical connector 13. The electrical connector 13 is crimped on a conductive wire 14. Such crimped connector has as a rule an edge at a front end of a conductor claw 15. In the shown example the edge is formed by a transverse web 16. The connector has as a rule an arresting tongue 17 which in inserted condition of the connector engages behind an arresting stepped edge 18 in the chamber 12 (FIG. 4).

The wall thickness of the frame 7 of the locking mount 1 corresponds to the wall thickness of the wall 5 of the housing chamber. Accordingly the inventive locking mount 1 adapts itself to the housing, and particularly the housing chamber wall 5 is inserted into a gap 19 between the arresting brackets 9 and the stopper 8 until lower edge 20 of the frame 7 abuts against an upper edge 21 of the housing (FIG. 4). For guaranteeing a pre-arresting and an end arresting of the locking mount 1 in the housing, the arresting bracket 9 cooperates with arresting webs 22 and 23 provided on the respective outer surface of the wall 5 of the housing chamber. The arresting webs 22 and 23 are arranged at a distance from one another and at a distance from the upper edge 21 and extend parallel to the latter. The arresting webs 22 and 23 cooperate with the transverse web 11 of the respective arresting bracket 9. Correspondingly the length of the arresting webs 22 and 23 is shorter than the lateral distance between the bracket arms 10.

Figure 3:
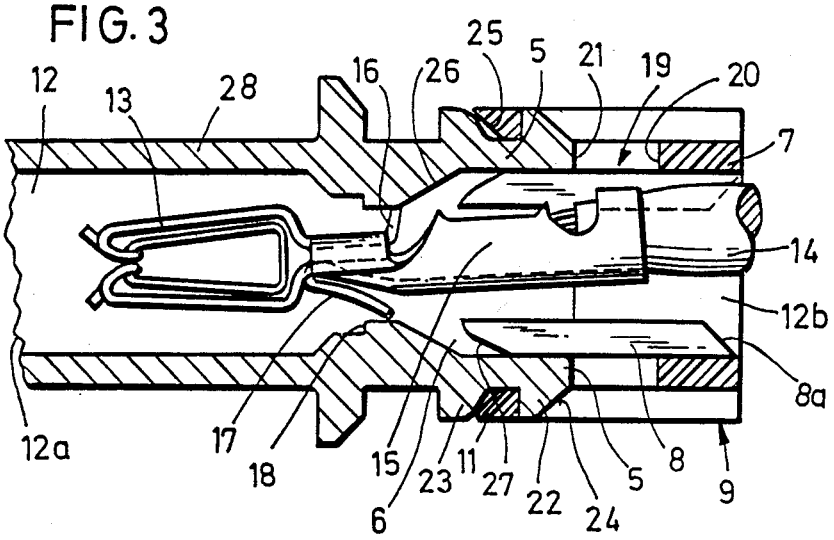
FIG. 3 is a view showing a longitudinal section of the inventive locking arrangement in a pre-arresting position of its locking mount.

When the locking mount 1 is inserted into the housing, the transverse web 11 abuts first against the arresting web 22. The web 22 has a substantially triangular cross-section and is provided with a lifting incline 24 extending toward the wall 5 of the housing chamber, whereas the transverse web 11 of the arresting bracket 9 has a lifting incline 25 extending substantially parallel to the lifting incline 24. With these inclines the transverse web 11 can slide over the arresting bracket 22 because the bracket arm 10 is elastically turnable until it springs back behind the arresting web 22 and becomes seated between the arresting webs 22 and 23. Since the distance between the arresting webs 22 and 23 substantially corresponds to the width of the transverse web 11, there is provided a position fixation of the transverse web 11 and therefore of the locking mount 1 in a prearresting position (FIG. 3).

When the locking mount 1 is in the pre-arresting position, the stoppers 8 arranged on the opposite walls **7*b* and 7*d* extend parallel to one another in the housing chamber 12. In this condition of the housing the crimped connector 13 can be introduced unobjectionably into the housing chamber 12. After this the locking mount 1 is pressed further onto the housing for the end arresting until the transverse web 11 snaps over the arresting web 23 and engages behind the latter, wherein the edges 20 and 21 abut against one another (FIG. 4). For facilitating the snapping step, the outer surface of the arresting web 23 is considerably rounded, so that the lifting incline 25 cannot slide over the arresting web 23 as easy as over the arresting web 22**.

It is important that the inner surface of the oppositely located walls 5 of the housing chamber are provided in the housing chamber 12 with a lifting incline 26 extending inwardly in direction toward an insertion opening **12*a*. The lifting incline 26 extend transverse to the longitudinal direction of the housing chamber. It cooperates for example with outwardly directly incline 27 provided in the end region of the stopper 8. During displacement of the locking mount 1 from the pre-arresting position into the end arresting position, the incline 27 runs up to the incline 26 before the end arresting position is attained. During further displacement the stopper 8 is squeezed inwardly and pressed against the claw 15 of the connector 13, so that the connector is displaced into the chamber until the locking mount 1** is finally arrested.

When the connector is assumed the required position before the end arresting position of the locking mount is attained, the stopper 8 acts as prongs when the end arresting position is obtained, since it engages around the claw 15 and thereby fixes the position of the connector. Moreover, the stopper 8 acts in the end arresting position in a locking manner, since the front edges of the stopper 8 prevent pulling of the connector from the chamber inasmuch as the front edges of the stopper abut against the edge 16 or a similar edge of the connector.

When the locking arrangement is designed in accordance with the present invention it provides a completely different way to lock a housing and to fix or clamp the connector inserted in the housing. The locking takes place since approximately each connector has an edge in the transition region between the claw part and the contact part. The structural length of the housing is not increased since the housing can be shortened in correspondence with the length of the frame 7. The manufacture of the inventive locking mount is simple since it is formed as an non-complicated synthetic plastic part. The housing can also be formed simple since the locking mount requires simple corresponding actuating elements such as lifting incline and arresting webs.

Figure 2:
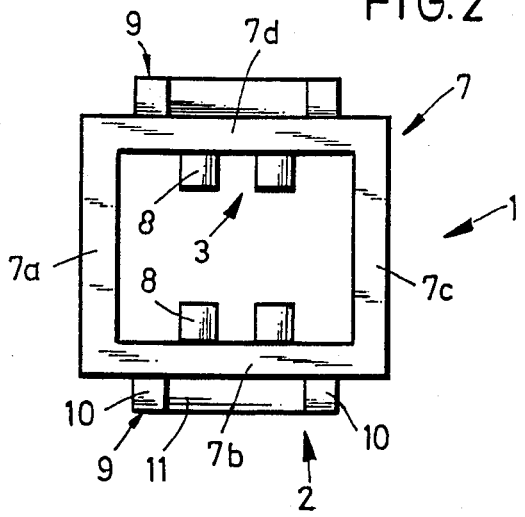
FIG. 2 is a plan view of locking mount of FIG. 1.

It is of advantage that the abutting rounding of the arresting web 23 counteracts the transverse web 11 with a greater resistance than the incline of the arresting web 22. Thereby the pre-arresting position is stabilized. The lifting incline 26 can advantageously be provided closer in direction to the insertion opening **12*b* than it is shown in the drawing, so that the stopper is in contact with the incline already in the pre-arresting position (FIG. 2). It is advantageous in the inventive locking mount when the stoppers 8 are inclined inwardly of the insertion opening 12*b* and thereby form an insertion incline 8*a*** which facilitates the insertion of the connector. It is important that the inventive locking mount provides for a considerable simpification of the automatic assembling of a housing. No swinging movements are needed as required in the event of hinge cover, and a simple linear movement provides for locking of the housing.

It will be understood that each of the elements described above, or two or more together, may also find a useful application in other types of constructions differing from the types described above.

While the invention has been illustrated and described as embodied in a locking arrangement for an electrical connector insertable into a housing chamber, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A locking arrangement for an electrical connector insertable into a housing chamber having walls, the locking arrangement comprising a plurality of first arresting elements arranged outwardly on the walls of the housing chamber; and a locking mount fittable onto the walls of the housing chamber and provided with a plurality of locking elements arranged for locking the electrical connector and with a plurality of second arresting elements cooperating with the first arresting elements of the walls of the housing chamber, said locking mount including a frame having a plurality of frame walls provided with said locking elements and said second arresting elements, said locking elements including at least one pin-shaped stopper arranged on one of said frame walls, and extending normally downwardly beyond said one frame wall.

2. A locking arrangement as defined in claim 1, wherein said frame is a rectangular.

3. A locking arrangement as defined in claim 1, wherein the walls of the housing chamber include two opposite housing chamber walls having inner surfaces, said housing chamber being elongated and provided with an insertion opening, said opposite housing chamber walls each having a lifting incline extending inwardly in direction toward said insertion opening and transverse to the direction of elongation of said housing chamber.

4. A locking arrangement as defined in claim 1, wherein said frame walls include at least one frame wall having an outer surface, said second arresting elements include at least one arresting bracket provided on said outer surface of said one frame wall and including two bracket arms which are spaced at a lateral distance from one another and extent parallel to one another and normally downwardly, and a transverse web connecting said bracket arms with one another.

5. A locking arrangement as defined in claim 1, wherein said frame walls include at least one wall having inner and outer surfaces, said locking elements including at least two pin-shaped stoppers arranged on said inner surface of said one frame wall at a lateral distance from one another and extending parallel normally downwardly of said one wall, said second arresting elements include at least one arresting bracket arranged on said outer surface of said one frame wall and extending normally downwardly of said one frame wall, said arresting brackets and said stopper extending over substantially equal lengths beyond said one frame wall.

6. A locking arrangement as defined in claim 1 wherein said walls of said frame have inner and outer opposite surfaces, said locking elements and said second arresting elements being arranged at least one some of said walls at opposite surfaces of the latter.

7. A locking arrangement for an electrical connector insertable into a housing chamber having walls, the locking arrangement comprising a plurality of first arresting elements arranged outwardly on the walls of the housing chamber; and a locking mount fittable onto the walls of the housing chamber and provided with a plurality of locking elements arranged for locking the electrical connector and with a plurality of second arresting elements cooperating with the first arresting elements of the walls of the housing chamber, said locking mount including a frame having a plurality of frame walls provided with said locking elements and said second arresting elements, said frame walls including one wall having a center and an inner surface, said locking elements including two pin-shaped stoppers arranged on said inner surface of said one wall at lateral distance from one another symmetrically to said center of said one wall, said stoppers extending parallel to one another and normally downwardly beyond said one wall over substantially a double length.

8. A locking arrangement as defined in claim 7 wherein said frame has another frame wall located opposite to said first mentioned frame wall, said locking elements including two further such pin-shaped stoppers arranged on the other wall opposite to said first mentioned stoppers.

9. A locking arrangement as defined in claim 7, wherein said stoppers have end regions provided with outwardly directed inclines.

* * * * *